US008442837B2

(12) United States Patent
Ashley et al.

(10) Patent No.: US 8,442,837 B2
(45) Date of Patent: May 14, 2013

(54) EMBEDDED SPEECH AND AUDIO CODING USING A SWITCHABLE MODEL CORE

(75) Inventors: James P. Ashley, Naperville, IL (US); Jonathan A. Gibbs, Winchester (GB); Udar Mittal, Bangalore (IN)

(73) Assignee: Motorola Mobility LLC, Libertyville, IL (US)

( * ) Notice: Subject to any disclaimer, the term of this patent is extended or adjusted under 35 U.S.C. 154(b) by 729 days.

(21) Appl. No.: 12/650,970

(22) Filed: Dec. 31, 2009

(65) Prior Publication Data

US 2011/0161087 A1 Jun. 30, 2011

(51) Int. Cl.
*G10L 19/00* (2006.01)
*G10L 11/00* (2006.01)

(52) U.S. Cl.
USPC ..... 704/501; 704/200

(58) Field of Classification Search ..... 704/200–230, 704/500–504
See application file for complete search history.

(56) References Cited

U.S. PATENT DOCUMENTS

| | | | | |
|---|---|---|---|---|
| 6,029,128 | A | 2/2000 | Jarvinen et al. | |
| 6,236,960 | B1 | 5/2001 | Peng et al. | |
| 6,263,312 | B1 | 7/2001 | Kolsnik et al. | |
| 6,424,940 | B1 | 7/2002 | Agassy et al. | |
| 6,658,383 | B2 | 12/2003 | Koishida et al. | |
| 7,130,796 | B2 | 10/2006 | Tasaki | |
| 7,739,120 | B2 * | 6/2010 | Makinen | 704/501 |
| 7,783,480 | B2 | 8/2010 | Yoshida | |
| 8,275,626 | B2 * | 9/2012 | Neuendorf et al. | 704/501 |
| 2003/0004711 | A1 * | 1/2003 | Koishida et al. | 704/223 |
| 2006/0047522 | A1 | 3/2006 | Ojanpera | |
| 2006/0173675 | A1 | 8/2006 | Ojanpera | |
| 2008/0065374 | A1 | 3/2008 | Mittal et al. | |
| 2010/0070269 | A1 * | 3/2010 | Gao | 704/207 |
| 2010/0280823 | A1 * | 11/2010 | Shlomot et al. | 704/201 |
| 2010/0292993 | A1 * | 11/2010 | Vaillancourt et al. | 704/500 |
| 2011/0016077 | A1 * | 1/2011 | Vasilache et al. | 706/52 |

FOREIGN PATENT DOCUMENTS

| | | | |
|---|---|---|---|
| EP | 1483759 | B1 | 8/2004 |
| EP | 1533789 | A1 | 5/2005 |
| EP | 1619664 | A1 | 1/2006 |
| EP | 1449205 | B1 | 9/2007 |
| EP | 1845519 | A2 | 10/2007 |
| WO | 2009055192 | A1 | 4/2009 |
| WO | 2009126759 | A1 | 10/2009 |

OTHER PUBLICATIONS

Scheirer and Kim; Generalized Audio Coding with MPEG-4 Structured Audio; Machine Listing Group, MIT Media Laboratory, Cambridge MA USA; 16 pages.

(Continued)

*Primary Examiner* — Samuel G Neway

(57) ABSTRACT

A method for processing an audio signal including classifying an input frame as either a speech frame or a generic audio frame, producing an encoded bitstream and a corresponding processed frame based on the input frame, producing an enhancement layer encoded bitstream based on a difference between the input frame and the processed frame, and multiplexing the enhancement layer encoded bitstream, a codeword, and either a speech encoded bitstream or a generic audio encoded bitstream into a combined bitstream based on whether the codeword indicates that the input frame is classified as a speech frame or as a generic audio frame, wherein the encoded bitstream is either a speech encoded bitstream or a generic audio encoded bitstream.

11 Claims, 5 Drawing Sheets

OTHER PUBLICATIONS

Purnhagen, An Overview of MPEG-4 Audio Version 2; Laboratorium Fur Informationstechologie; University of Hannover, Hannover, Germany; 12 pages.
Ramprashad; A Two Stage Hybrid Embedded Speech/Audio Coding Structure; Bell Laboratories, Lucent Technologies; Murray Hill, NJ; 4 pages.
Ramprashad; The Multimode Transform Predictive Coding Paradigm; IEEE Transactions on Speech and Audio Processing, vol. 11, No. 2, Mar. 2003; 13 pages.
Tancerel, et al., "Combined Speech and Audio Coding by Discrimination" Proceedings of the 2000 IEEE Workshop on Speech Coding, Sep. 17-20, 2000, pp. 154-156.
Qualcomm Inc., "Draft ToRs, Time Schedule and Qualification Test Conditions to Develop EVRC-WB Interworking Annex to G.EV-VBR"; International Telecommunication Union; COM16-C440-E; Apr. 2008; 11 pages.
Mittal, et al., "Coding Unconstrained FCB Excitation Using Combinatorial and Huffman Codes," Proceedings of the 2002 IEEE Workshop on Speech Coding, Oct. 6-9, 2002, pp. 129-131.
Ashley, et al., Wideband Coding of Speech Using a Scalable Pulse Codebook, Proceedings of the 2000 IEEE Workshop on Speech Coding, Sep. 17-20, 2000, pp. 148-150.
Mittal, et al.,"Low Complexity Factorial Pulse Coding of MDCT Coefficients using Approximation of Combinatorial Functions," IEEE International Conference on Acoustics, Speech and Signal Processing, 2007, ICASSP 2007, Apr. 15-20, 2007, pp. I-289 -I-292.
3rd Gerneration Partnership Project, "3GPP TS 26.290 V7.0.0 (Mar. 2007); 3rd Generation Partnership Project; Technical Specification Group Service and System Aspects; Audio Codec Processing Functions; Extended Adaptive Multi-Rate-Wideband (AMR-WB+) Codec; Transcoding Functions," 3rd generation Partnership Project, Release 7, Mar. 2007.
Chan, et al., "Frequency Domain Postfiltering for Multiband Excited Linear Predictive Coding of Speech," Electronics Letters, Jun. 6, 1996, pp. 1061-1063.
Chen, et al., "Adaptive Postfiltering for Quality Enhancement of Coded Speech," IEEE Transactions on Speech and Audio Processing, vol. 3, No. 1, Jan. 1995, pp. 59-71.
Andersen, et al., "Reverse Water-Filling in Predictive Encoding of Speech," Proceedings of the 1999 IEEE Workshop on Speech Coding, Jun. 20-23, 1999, pp. 105-107.
Makinen, et al., "AMR-WB+: A New Audio Coding Standard for 3rd Generation Mobile Audio Service," Proceedings of the IEEE International Conference on Acoustics, Speech and Signal Processing, 2005, ICASSP'05, vol. 2, Mar. 18-23, 2005, pp. ii/1109-ii/1112.
Faller, et al., "Technical Advances in Digital Audio Radio Broadcasting," Proceedings of the IEEE, vol. 90, Issue 8, Aug. 2002, pp. 1303-1333.
Salami, et al., "Extended AMR-WB for High-Quality Audio on Mobile Devices," IEEE Communications Magazine, vol. 44, Issue 5, May 2006, pp. 90-97.
Hung, et al., "Error-Resilient Pyramid Vector Quantization for Image Compression," IEEE Transactions on Image Processing, vol. 7, Issue 10, Oct. 1998, pp. 1373-1386.
Kovesi, et al., "A Scalable Speech and Adiuo Coding Scheme with Continuous Bitrate Flexibility," Proceedings of the IEEE International Conference on Acoustics, Speech and Signal Processing 2004 (ICASSP '04) Montreal, Quebec, Canada, May 17-21, 2004, vol. 1, pp. 273-276.
Ramprashad, "Embedded Coding Using a Mixed Speech and Audio Coding Paradigm," International Journal of Speech Technology, Kluwer Academic Publishers, Netherlands, vol. 2, No. 4, May 1999, pp. 359-372.
Patent Cooperation Treaty, "PCT Search Report and Written Opinion of the International Searching Authority" for International Application No. PCT/US2008/077693 (CML06419) Dec. 15, 2008, 12 pages.
Ramprashad, "High Quality Embedded Wideband Speech Coding Using an Inherently Layered Coding Paradigm," Proceedings of International Conference on Acoustics, Speech, and Signal Processing, ICASSP 2000, vol. 2, Jun. 5-9, 2000, pp. 1145-1148.
International Telecommunication Union, "G.729.1, Series G: Transmission Systems and Media, Digital Systems and Networks, Digital Terminal Equipments—Coding of analogue signals by methods other than PCM,G.729 based Embedded Variable bit-rate coder: An 8-32 kbit/s scalable wideband coder bitstream interoperable with G.729," ITU-T Recomendation G.729.1, May 2006, Cover page, pp. 11-18. Full document available at: http://www.itu.int/rec/T-REC-G.729.1-200605-I/en.
USPTO U.S. Appl. No. 12/187,423; "Method and Apparatus for Generating an Enhancement Layer within an Audio Coding System"; Motorola Docket No. CML06419; Specification 19 pages.
3rd Generation Partnership Project 2; 3GPP2 C.20014-D, Version1.0, May 2009; "Enhanced Variable Rate Codec, Speech Service Options 3, 68, 70, and 73 for Wideband Spread Spectrum Digital Systems".
International Telecommunication Union, G.718, Series G: Transmission Systems and Media, Digital Systems and Networks, Digital Terminal Equipments—Coding of analogue signals by methods other than PCM; Frame Error Robust Narrowband and Wideband Embedded Variable bit-rate Coding of Speech and Audio from 8-32 kbit/s.
Patent Cooperation Treaty, "PCT Search Report and Written Opinion of the International Searching Authority" for International Application No. PCT/US2010/058193 (CS37078AUD) Feb. 8, 2011, 10 pages.
Jelinek et al. "ITU-T G.EV-VBR Baseline Codec" IEEE International Conference on Acoustics, Speech and Signal Processing, 2008, pp. 4749-4752.

* cited by examiner

EMBEDDED SPEECH AND AUDIO CODING USING A SWITCHABLE MODEL CORE

FIELD OF THE DISCLOSURE

The present disclosure relates generally to speech and audio coding and, more particularly, to embedded speech and audio coding using a hybrid core codec with enhancement encoding.

BACKGROUND

Speech coders based on source-filter models are known to have quality problems processing generic audio input signals such as music, tones, background noise, and even reverberant speech. Such codecs include Linear Predictive Coding (LPC) processors like Code Excited Linear Prediction (CELP) coders. Speech coders tend to process speech signals low bit rates. Conversely, generic audio coding systems based on auditory models typically don't process speech signals very well to sensitivities to distortion in human speech coupled with bit rate limitations. One solution to this problem has been to provide a classifier to determine, on a frame by frame basis, whether an input signal is more or less speech like, and then to select the appropriate coder, i.e., a speech or generic audio coder, based on the classification. An audio signal processer capable of processing different signal types is sometimes referred to as a hybrid core codec.

An example of a practical system using a speech-generic audio input discriminator is described in EVRC-WB (3GPP2 C.S0014-C). The problem with this approach is, as a practical matter, that it is often difficult to differentiate between speech and generic audio inputs, particularly where the input signal is near the switching threshold. For example, the discrimination of signals having a combination of speech and music or reverberant speech may cause frequent switching between speech and generic audio coders, resulting in a processed signal having inconsistent sound quality.

Another solution to providing good speech and generic audio quality is to utilize an audio transform domain enhancement layer on top of a speech coder output. This method subtracts the speech coder output signal from the input signal, and then transforms the resulting error signal to the frequency domain where it is coded further. This method is used in ITU-T Recommendation G.718. The problem with this solution is that when a generic audio signal is used as input to the speech coder, the output can be distorted, sometimes severely, and a substantial portion of the enhancement layer coding effort goes to reversing the effect of noise produced by signal model mismatch, which leads to limited overall quality for a given bit rate.

The various aspects, features and advantages of the invention will become more fully apparent to those having ordinary skill in the art upon careful consideration of the following Detailed Description thereof with the accompanying drawings described below. The drawings may have been simplified for clarity and are not necessarily drawn to scale.

DETAILED DESCRIPTION

The disclosure is drawn generally to methods and apparatuses for processing audio signals and more particularly for processing audio signals arranged in a sequence, for example, a sequence of frames or sub-frames. The input audio signals comprising the frames are typically digitized. The signal units are generally classified, on a unit by unit basis, as being more suitable for one of at least two different coding schemes. In one embodiment, the coded units or frames are combined with an error signal and an indication of the coding scheme for storage or communication. The disclosure is also drawn to methods and apparatuses for decoding the combination of the coded units and the error signal based on the coding scheme indication. These and other aspects of the disclosure are discussed more fully below.

In one embodiment, the audio signals are classified as being more or less speech like, wherein more speech-like frames are processed with a codec more suitable for speech-like signals, and the less speech-like frames are processed with a codec more suitable for less speech like signals. The present disclosure is not limited to processing audio signal frames classified as either speech or generic audio signals. More generally, the disclosure is directed toward processing audio signal frames with one of at least two different coders without regard for the type of codec and without regard for the criteria used for determining which coding scheme is applied to a particular frame.

In the present application, less speech-like signals are referred to as generic audio signals. Generic audio signal however are not necessarily devoid of speech. Generic audio signals may include music, tones, background noise or combinations thereof alone or in combination with some speech. A generic audio signal may also include reverberant speech. That is, a speech signal that has been corrupted by large amounts of acoustic reflections (reverb) may be better suited for coding by a generic audio coder since the model parameters on which the speech coding algorithm is based may have been compromised to some degree. In one embodiment, a frame classified as a generic audio frame includes non-speech with speech in the background, or speech with non-speech in the background. In another embodiment, a generic audio frame includes a portion that is predominantly non-speech and another, less prominent, portion that is predominantly speech.

Figure 1:
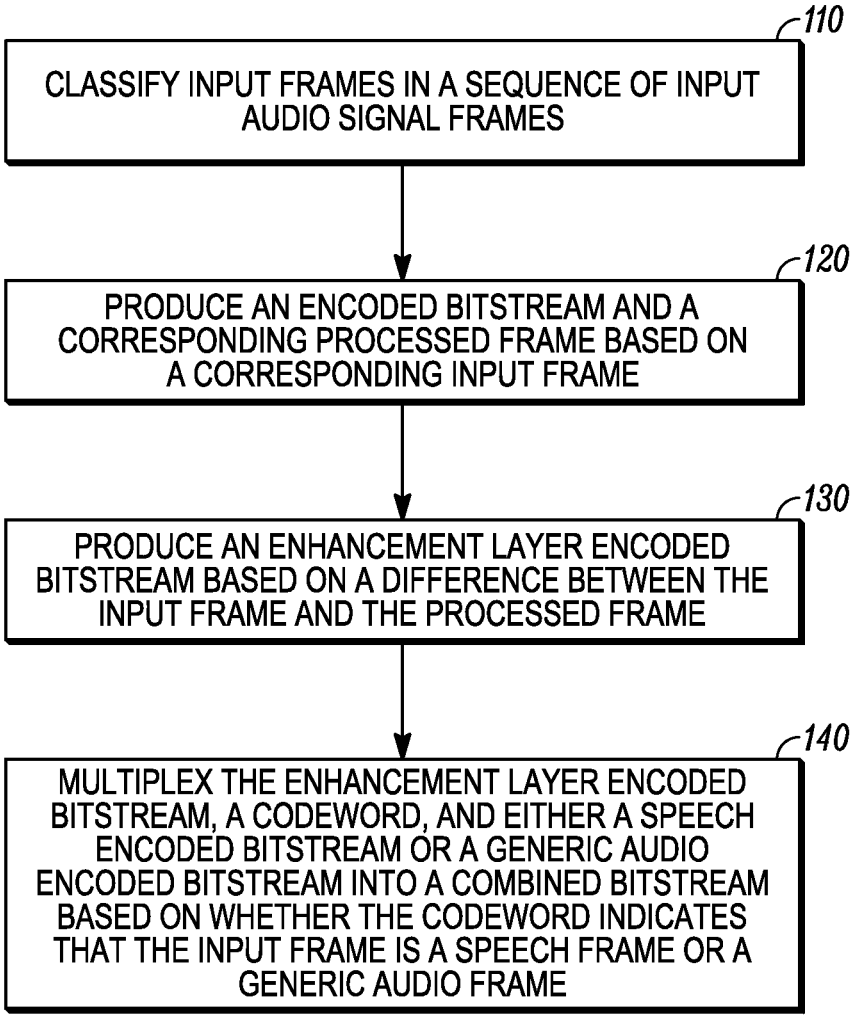
FIG. 1 is an audio signal encoding process diagram.

In the process 100 of FIG. 1, at 110, an input frame in a sequence of frames is classified as being one of at least two different pre-specified types of frames. In the exemplary implementation, an input audio signal comprises a sequence of frames that are each classified as either a speech frame or a generic audio frame. More generally however, the input frames could be classified as one of at least two different types of audio frames. In other words, the frames need not necessarily be distinguished based on whether they are speech frames or generic audio frames. More generally, the input frames may be assessed to determine how best to code the frame. For example, a sequence of generic audio frames may be assessed to determine how best to code the frames using one of at least two different codecs. The classification of audio frames is generally well known to those having ordinary skill in the art and thus a detailed discussion of the criteria and discrimination mechanism is beyond the scope of the instant disclosure. The classification may occur either before coding or after coding as discussed further below.

Figure 2:
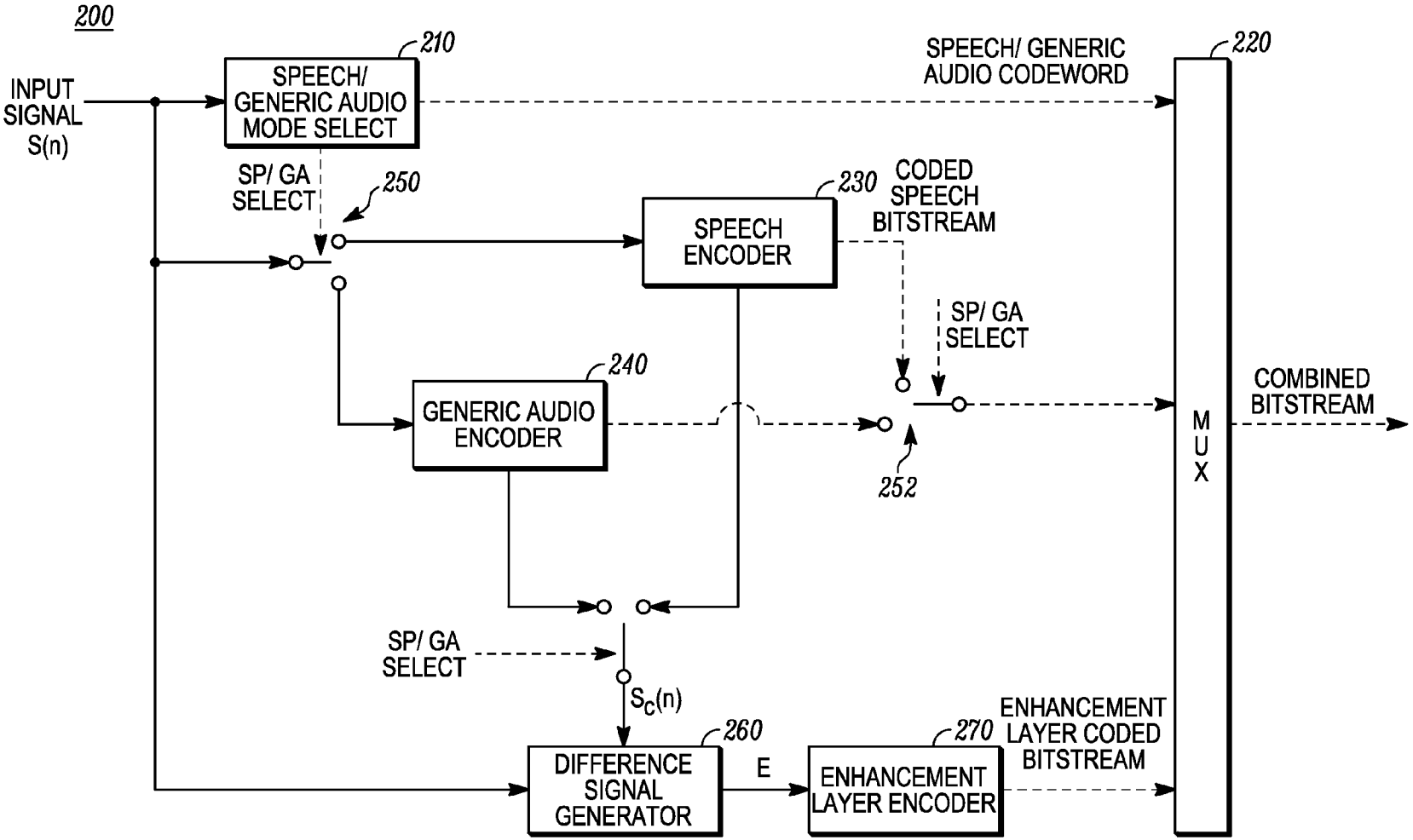
FIG. 2 is a schematic block diagram of a hybrid core codec suitable for processing speech and generic audio signals.
Figure 3:
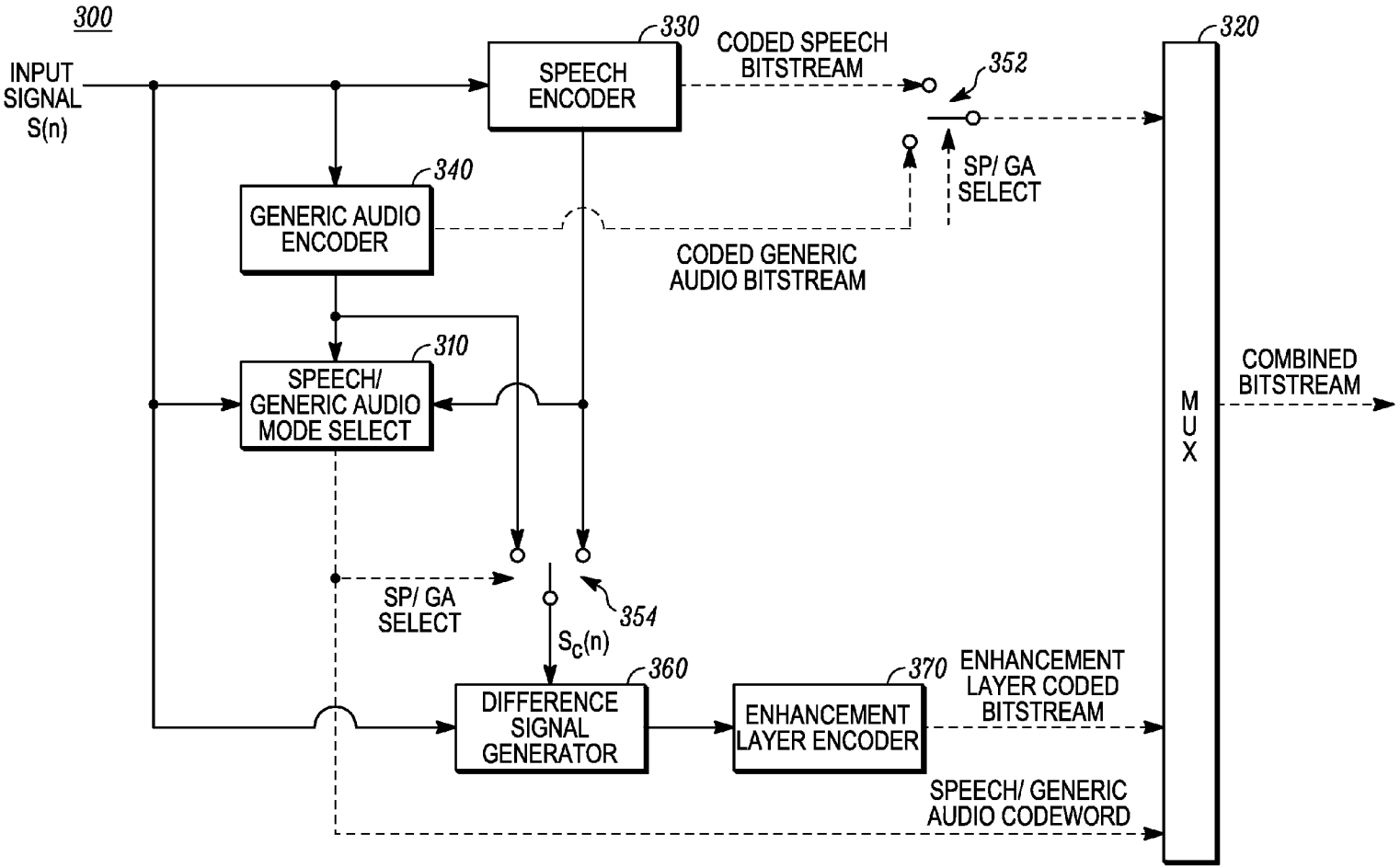
FIG. 3 is a schematic block diagram of an alternative hybrid core codec suitable for processing speech and generic audio signals.

FIG. 2 illustrates a first schematic block diagram of an audio signal processor 200 that processes frames of an input audio signal s(n), where "n" is an audio sample index. The audio signal processor comprises a mode selector 210 that classifies frames of the input audio signal s(n). FIG. 3 also illustrates a schematic block diagram of another audio signal processor 300 comprising a mode selector 310 that classifies frames of an input audio signal s(n). The exemplary mode selectors determine whether frames of the input audio signal are more or less speech like. More generally, however, other criteria of the input audio frames may be assessed as a basis for the mode selection. In both FIGS. 2 and 3, a mode selection codeword is generated by the mode selector and provided to a multiplexor 220 and 320, respectively. The codeword may comprising one or mode bits indicative of the mode of operation. Particularly, the codeword indicates, on a frame by frame basis, the mode by which a corresponding frame of the input signal is processed. Thus, for example, the codeword indicates whether an input audio frame is processed as a speech signal or as a generic audio signal.

In FIG. 1, at 120, an encoded bitstream and a corresponding processed frame are produced based on a corresponding frame of the input audio signal. In FIG. 2, the audio signal processor 200 comprises a speech coder 230 and a generic audio coder 240. The speech coder is for example a code excited linear prediction (CELP) coder or some other coder particularly suitable for coding speech signals. The generic audio coder is for example a Time Domain Aliasing Cancellation (TDAC) type coder, like a modified discrete cosine transform (MDCT) coder. More generally however the coders 230 and 240 could be any different coders. For example, the coders could be different types of CELP class coders optimized for different types of speech. The coder could also be different types of TDAC class coders or some other class of coders. As suggested, each coder produces an encoded bitstream based on the corresponding input audio frame processed by the coder. Each coder also produces a corresponding processed frame, which is a reconstruction of the input signal, indicated by $s_c(n)$. The reconstructed signal is obtained by decoding the encoded bit stream. For convenience of illustration, the encoding and decoding functionality are represented by single functional block in the drawings, but the generation of encoded bitstream could be represented by an encoding block and the reconstructed input signal could be represented by a separate decoding block. Thus the reconstructed frame is subject to both encoding and decoding.

In FIG. 2, the first and second coders 230 and 240 have inputs coupled to the input audio signal by a selection switch 250 that is controlled based on the mode selected or determined by the mode selector 210. For example, the switch 250 may be controlled by a processor based on the codeword output of the mode selector. The switch 250 selects the speech coder 230 for processing speech frames and the switch 250 selects the generic audio coder for processing generic audio frames. In FIG. 2, each frame is processed by only one coder, e.g., either the speech coder or the generic audio coder, by virtue of the selection switch 250. While only two coders are illustrated in FIG. 2, more generally, the frames may be processed by one of several different coders. For example, one of three or more coders may be selected to process a particular frame of the input audio signal. In other embodiments, however, each frame is processed by all coders as discussed further below.

In FIG. 2, a switch 252 on the output of the coders 230 and 240 couples the processed output of the selected coder to the multiplexer 220. More particularly, the switch couples the encoded bitstream output of the selected coder to the multiplexor. The switch 252 is controlled based on the mode selected or determined by the mode selector 210. For example, the switch 252 may be controlled by a processor based on the codeword output of the mode selector 210. The multiplexor 220 multiplexes the codeword with the encoded bitstream output of the corresponding coder selected based on the codeword. Thus for generic audio frames, the switch 252 couples the output of the generic audio coder 240 to the multiplexor 220, and for speech frames the switch 252 couples the output of the speech coder 230 to the multiplexor.

In FIG. 3, the input audio signal is applied directly to the first and second coders 330 and 340 without the use of a selection switch, for example, switch 250 in FIG. 2. In the processor of FIG. 3, each frame of the input audio signal is processed by all coders, e.g., the speech coder 330 and the generic audio coder 340. Generally, each coder produces an encoded bitstream based on the corresponding input audio frame processed by the coder. Each coder also produces a corresponding processed frame by decoding the encoded bit stream, wherein the processed frame is a reconstruction of the input frame indicated by $s_c(n)$. Generally, the input audio signal may be subject to delay by a delay entity, not shown, inherent to the first and/or second coders. The input audio signal may also be subject to filtering by a filtering entity, not shown, preceding the first or second coders. In one embodiment, the filtering entity performs re-sampling or rate conversion processing on the input signal. For example, an 8, 16 or 32 kHz input audio signal may be converted to a 12.8 kHz signal, which is typical of a speech signal. More generally, while only two coders are illustrated in FIG. 3 there may be multiple coders.

In FIG. 3, a switch 352 on the output of the coders 330 and 340 couples the processed output of the selected coder to the multiplexer 320. More particularly, the switch couples the encoded bitstream output of the coder to the multiplexor. The switch 352 is controlled based on the mode selected or determined by the mode selector 310. For example, the switch 352 may be controlled by a processor based on the codeword output of the mode selector 310. The multiplexor 320 multiplexes the codeword with the encoded bitstream output of the corresponding coder selected based on the codeword. Thus for generic audio frames, the switch 352 couples the output of the generic audio coder 340 to the multiplexor 320, and for speech frames the switch 352 couples the output of the speech coder 330 to the multiplexor.

In FIG. 1, at 130, an enhancement layer encoded bitstream is produced based on a difference between the input frame and a corresponding processed frame generated by the selected coder. As noted, the processed frame is a reconstructed frame $s_c(n)$. In the processor of FIG. 2, a difference signal is generated by a difference signal generator 260 based on a frame of the input audio signal and the corresponding processed frame output by the coder associated with the selected mode, as indicated by the codeword. A switch 254 at the output of the coders 230 and 240 couples the selected coder output to the difference signal generator 260. The difference signal is identified as an error signal E.

The difference signal is input to an enhancement layer coder 270, which generates the enhancement layer bitstream based on the difference signal. In the alternative processor of FIG. 3, a difference signal is generated by a difference signal generator 360 based on a frame of the input audio signal and the corresponding processed frame output by the corresponding coder associated with the selected mode, as indicated by the codeword. A switch 354 at the output of the coders 330 and 340 couples the selected coder output to the difference signal generator 360. The difference signal is input to an enhancement layer coder 370, which generates the enhancement layer bitstream based on the difference signal.

In some implementations, the frames of the input audio signal are processed before or after generation of the difference signal. In one embodiment, the difference signal is weighted and transformed into the frequency domain, for example using an MDCT, for processing by the enhancement layer encoder. In the enhancement layer, the error signal is comprised of a weighted difference signal that is transformed into the MDCT (Modified Discrete Cosine Transform) domain for processing by an error signal encoder, e.g., the enhancement layer encoder in FIGS. 2 and 3. The error signal E is given as:

$$E=\mathrm{MDCT}\{W(s-s_c)\}, \quad \text{Eqn. (1)}$$

where W is a perceptual weighting matrix based on the Linear Prediction (LP) filter coefficients A(z) from the core layer decoder, s is a vector (i.e., a frame) of samples from the input audio signal s(n), and $s_c$ is the corresponding vector of samples from the core layer decoder.

In one embodiment, the enhancement layer encoder uses a similar coding method for frames processed by the speech coder and for frames processed by the generic audio coder. In the case where the input frame is classified as a speech frame that is coded by a CELP coder, the linear prediction filter coefficients (A(z)) generated by the CELP coder are available for weighting the corresponding error signal based on the difference between the input frame and the processed frame $s_c(n)$ output by the speech (CELP) coder. However, for the case where the input frame is classified as a generic audio frame coded by a generic audio coder using an MDCT based coding scheme, there are no available LP filter coefficients for weighting the error signal. To address this situation, in one embodiment, LP filter coefficients are first obtained by performing an LPC analysis on the processed frame $s_c(n)$ output the generic audio coder before generation of the error signal at the difference signal generator. These resulting LPC coefficients are then used for generation of the perceptual weighting matrix W applied to the error signal before enhancement layer encoding.

In another implementation, the generation of the error signal E includes modification of the signal $s_c(n)$ by pre-scaling. In a particular embodiment, a plurality of error values are generated based on signals that are scaled with different gain values, wherein the error signal having a relatively low value is used to generate the enhancement layer bitstream. These and other aspects of the generation and processing of the error signal are described more fully in U.S. Publication No. 20090112607 corresponding to U.S. application Ser. No. 12/187,423 entitled "Method and Apparatus for Generating an Enhancement Layer within an Audio Coding System".

In FIG. 1, at 140, the enhancement layer encoded bitstream, the codeword, and the encoded bitstream all based on a common frame of the input audio signal are multiplexed into a combined bitstream. For example, if the frame of the input audio signal is classified as a speech frame, the encoded bit stream is produced by the speech coder, the enhancement layer bitstream is based on the processed frame produced by the speech coder, and the codeword indicates that the corresponding frame of the input audio signal is a speech frame. For the case where the frame of the input audio signal is classified as a generic audio frame, the encoded bit stream is produced by the generic audio coder, the enhancement layer bitstream is based on the processed frame produced by the generic audio coder, and the codeword indicates that the corresponding frame of the input audio signal is a generic audio frame. Similarly, for any other coder, the codeword indicates the classification of the input audio frame, and the coded bit stream and processed frame are produced by the corresponding coder.

In FIG. 2, the codeword corresponding to the classification or mode selected by the mode selecting entity 210 is sent to the multiplexor 220. A second switch 252 on the output of the coders 230 and 240 couples the coder corresponding to the selected mode to the multiplexor 220 so that the corresponding coded bit stream is communicated to the multiplexor. Particularly, the switch 252 couples the encoded bitstream output of either the speech coder 230 or the generic audio coder 240 to the multiplexor 220. The switch 252 is controlled based on the mode selected or determined by the mode selector 210. The switch 252 may be controlled by a processor based on the codeword output of the mode selector. The enhancement layer bitstream is also communicated from the enhancement layer coder 270 to the multiplexor 220. The multiplexor combines the codeword, the selected coder bitstream, and the enhancement layer bit stream. For example, in the case of a generic audio frame, the switch 250 couples the input signal to the generic audio encoder 240 and the switch 252 couples the output of the generic audio coder to the multiplexor 220. The switch 254 couples the processed frame generated by the generic audio coder to the difference signal generator, the output of which is used to generate the enhancement layer bitstream, which is multiplexed with the codeword and the coded bitstream. The multiplexed information may be aggregated for each frame of the input audio signal and stored and/or communicated for later decoding. The decoding of the combined information is discussed below.

In FIG. 3, the codeword corresponding to the classification or mode selected by the mode selecting entity 310 is sent to the multiplexor 320. A second switch 352 on the output of the coders 330 and 340 couples the coder corresponding to the selected mode to the multiplexor 320 so that the corresponding coded bit stream is communicated to the multiplexor. Particularly, the switch 352 couples the encoded bitstream output of either the speech coder 330 or the generic audio coder 340 to the multiplexor 320. The switch 352 is controlled based on the mode selected or determined by the mode selector 310. The switch 352 may be controlled by a processor based on the codeword output of the mode selector. The enhancement layer bitstream is also communicated from the enhancement layer coder 370 to the multiplexor 320. The multiplexor combines the codeword, the selected coder bitstream, and the enhancement layer bit stream. For example, in the case of a speech frame, the switch 352 couples the output of the speech coder 330 to the multiplexor 320. The switch 354 couples the processed frame generated by the speech coder to the difference signal generator 360, the output of which is used to generate the enhancement layer bitstream, which is multiplexed with the codeword and the coded bitstream. The multiplexed information may be aggregated for each frame of the input audio signal and stored and/or communicated for later decoding. The decoding of the combined information is discussed below.

Generally the input audio signal may be subject to delay, by a delay entity not shown, inherent to the first and/or second coders. Particularly, a delay element may be required along one or more of the processing paths to synchronize the information combined at the multiplexor. For example, the generation of the enhancement layer bitstream may require more processing time relative to the generation of one of the encoded bitstreams. Thus it may be necessary to delay the encoded bitstream in order synchronize it with the coded enhancement layer bitstream. Communication of the codeword may also be delayed in order to synchronize the codeword with the coded bit stream and the coded enhancement layer. Alternatively, the multiplexor may store and hold the codeword, and the coded bitstreams as they are generated and perform the multiplexing only after receipt of all of the element to be combined.

The input audio signal may be subject to filtering, by a filtering entity not shown, preceding the first or second coders. In one embodiment, the filtering entity performs re-sampling or rate conversion processing on the input signal. For example, an 8, 16 or 32 kHz input audio signal may be converted to a 12.8 kHz speech signal. More generally, the signal to all of the coders may be subject to a rate conversion, either upsampling or downsampling. In embodiments where one frame type is subject to rate conversion and the other frame type is not, is may be necessary to provide some delay in the processing of the frame that are not subject to rate conversion. One or more delay elements may also be desirable where the conversion rates of different frame type introduce different amounts of delay.

In one embodiment, the input audio signal is classified as either a speech signal or a generic audio signal based on corresponding sets of processed audio frames produced by the different audio coders. In the exemplary speech and generic audio signal processing embodiment, such an implementation suggests that the input frame be processed by both the audio coder and the speech coder before mode selection occurs or is determined. In FIG. 3, the mode selecting entity 310 classifies an input frame of the input audio signal as either a speech frame or a generic audio frame based on a speech processed frame generated by the speech coder 330 and based on a generic audio processed frame generated by the generic audio coder 340. In a more specific implementation, the input frame is classified based on a comparison of first and second difference signals, wherein the first difference signal is generated based on the input frame and a speech processed frame and the second difference signal is generated based on the input frame and a generic audio processed frame. For example, an energy characteristic of a first set of difference signal audio samples associated with the first difference signal may be compared to the energy characteristic of a second set of difference signal audio samples associated with the second difference signal. To implement this latter approach, the schematic block diagram of FIG. 3 would require some modification to include output from one or more difference signal generators to the mode selecting entity 310. These implementations are also applicable to embodiments where other types of coders are employed.

Figure 4:
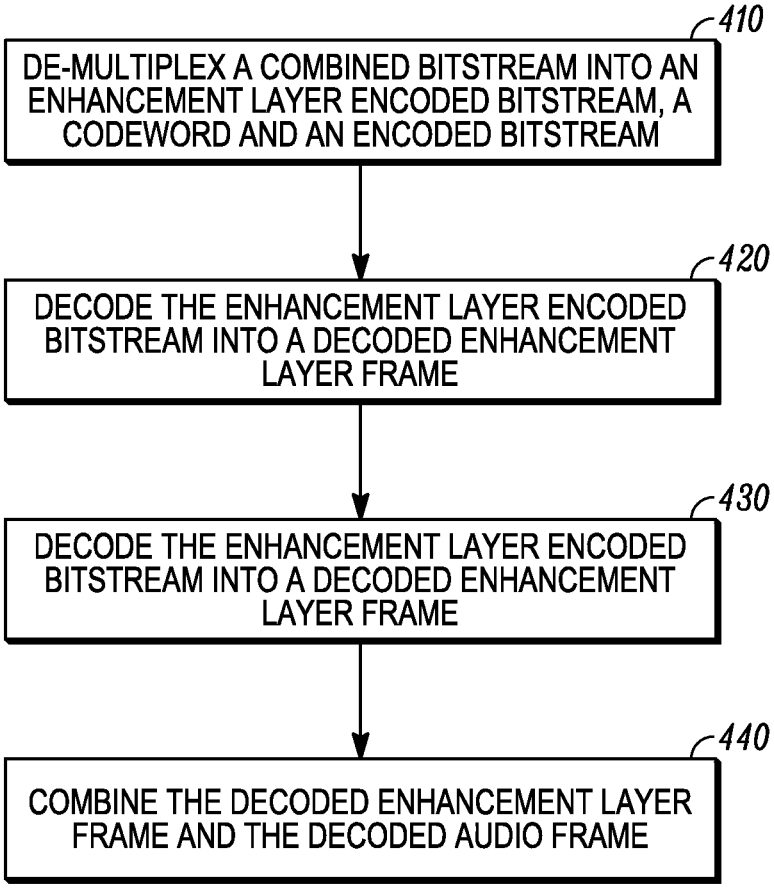
FIG. 4 is an audio signal decoding process diagram.
Figure 5:
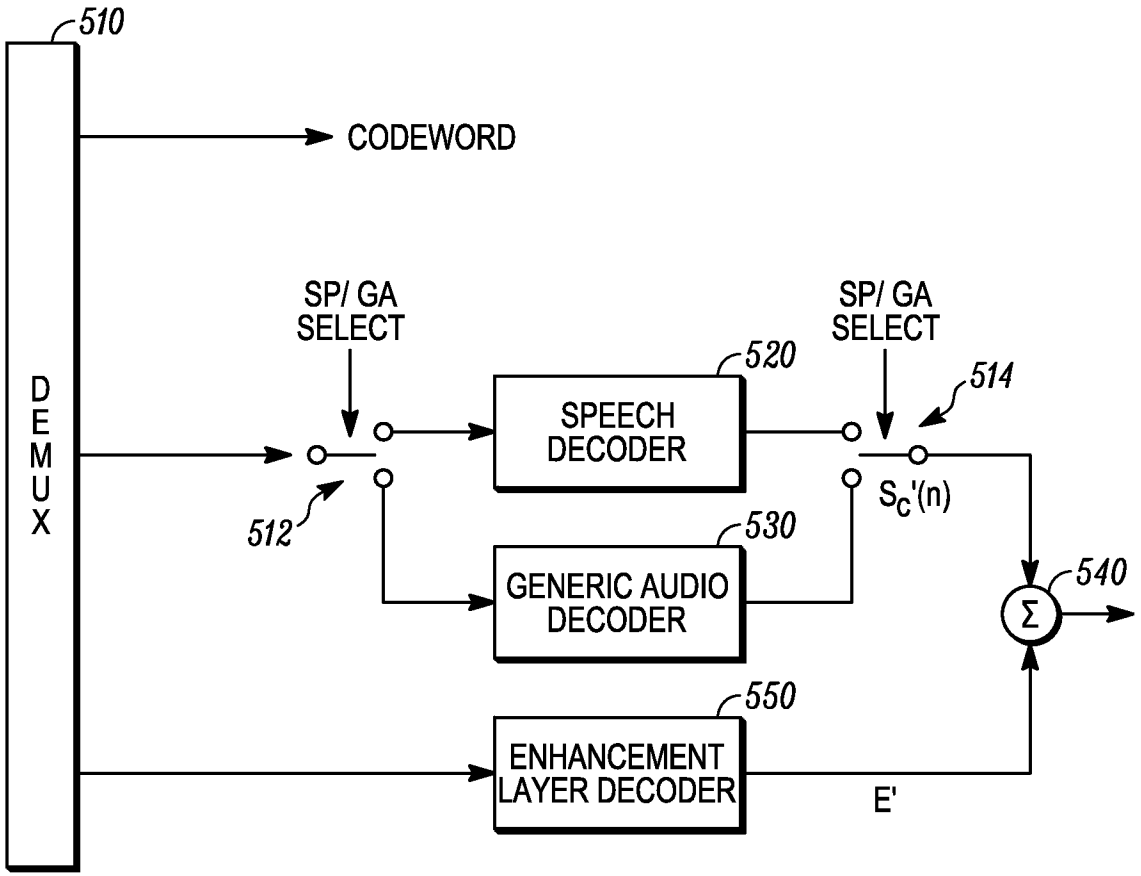
FIG. 5 is a decoder portion of a hybrid core codec.

In FIG. 4, at 410, a combined bitstream is de-multiplexed into an enhancement layer encoded bitstream, a codeword and an encoded bitstream. In FIG. 5, a de-multiplexor 510 performs the processes the combined bitstream to produce the codeword, the enhancement layer bitstream, and the encoded bit stream. The codeword indicates the mode selected and particularly the type of coder used to encode the encoded bitstream. In the exemplary embodiment, the codeword indicates whether the encoded bitstream is a speech encoded bitstream or a generic audio encoded bitstream. More generally however the codeword may be indicative of a coder other than a speech or generic audio coder. Some examples of alternative coders are discussed above.

In FIG. 5, a switch 512 selects a decoder for decoding the coded bitstream based on the codeword. Particularly, the switch 512 selects either the speech decoder 520 or the generic audio decoder 530 thereby routing or coupling the coded bitstream to the appropriate decoder. The coded bitstream is processed by the appropriate decoder to produce the processed audio frame identified as $s'_c(n)$, which should be the same as signal $s_c(n)$ at the encoder side provided there are no channel errors. In most practical implementations, the processed audio frame $s'_c(n)$ will be different than the corresponding frame of the input signal $s_c(n)$. In some embodiments, a second switch 514 couples the output of the selected decoder to a summing entity 540, the function of which is discussed further below. The state of the one or more switches is controlled based on the mode selected, as indicated by the codeword, and may be controlled by a processor based on the codeword output of the de-multiplexor.

In FIG. 4, at 430, the enhancement layer encoded bitstream output is decoded into a decoded enhancement layer frame. In FIG. 5, an enhancement layer decoder 550 decodes the enhancement layer encoded bitstream output from the de-multiplexor 510. The decoded error signal is indicated as E' since the decoded error or difference signal is an approximation of the original error signal E. In FIG. 4 at 440, the decoded enhancement layer encoded bitstream is combined with the decoded audio frame. In the signal decoding processor of FIG. 5, the approximated error signal E' is combined with the processed audio signal $s'_c(n)$ to reconstruct the corresponding estimate of the input frame s'(n). In embodiments where the error signal is weighted, e.g., by the weighting matrix in Equation (1) above, and where the encoded bitstream is a generic audio encoded bitstream, an inverse weighting matrix is applied to the weighted error signal before combining. These and other aspects of the reconstruction of the original input frame, depending on the generation and processing of the error signal, are described more fully in U.S. Publication No. 20090112607 corresponding to U.S. application Ser. No. 12/187,423 entitled "Method and Apparatus for Generating an Enhancement Layer within an Audio Coding System".

While the present disclosure and the best modes thereof have been described in a manner establishing possession and enabling those of ordinary skill to make and use the same, it will be understood and appreciated that there are equivalents to the exemplary embodiments disclosed herein and that modifications and variations may be made thereto without departing from the scope and spirit of the inventions, which are to be limited not by the exemplary embodiments but by the appended claims.

What is claimed is:

1. A method for encoding an audio signal, the method comprising:

classifying an input frame as either a speech frame or a generic audio frame, the input frame based on the audio signal;

producing an encoded bitstream and a corresponding processed frame based on the input frame;

producing an enhancement layer encoded bitstream based on a difference between the input frame and the processed frame; and multiplexing the enhancement layer encoded bitstream, a codeword, and either a speech encoded bitstream or a generic audio encoded bitstream into a combined bitstream based on whether the codeword indicates that the input frame is classified as a speech frame or as a generic audio frame;

wherein the encoded bitstream is either a speech encoded bitstream or a generic audio encoded bitstream;

wherein producing the corresponding processed frame includes producing a speech processed frame and producing a generic audio processed frame; and wherein classifying the input frame is based on the speech processed frame and the generic audio processed frame.

2. The method of claim 1 further comprising:

producing at least a speech encoded bitstream and at least a corresponding speech processed frame based on the input frame when the input frame is classified as a speech frame, and producing at least a generic audio encoded bitstream and at least a generic audio processed frame based on the input frame when the input frame is classified as a generic audio frame;

multiplexing the enhancement layer encoded bitstream, the speech encoded bitstream, and the codeword into the combined bitstream only when the input frame is classified as a speech frame; and multiplexing the enhancement layer encoded bitstream, the generic audio encoded bitstream, and the codeword into the combined bitstream only when the input frame is classified as a generic audio frame.

3. The method of claim 2 further comprising:

producing the enhancement layer encoded bitstream based on the difference between the input frame and the processed frame;

wherein the processed frame is a speech processed frame when the input frame is classified as a speech frame; and wherein the processed frame is a generic audio processed frame when the input frame is classified as a generic audio frame.

4. The method of claim 3:

wherein the processed frame is a generic audio frame;

the method further comprising:

obtaining linear prediction filter coefficients by performing a linear prediction coding analysis of the processed frame of the generic audio coder; and weighting the difference between the input frame and the processed frame of the generic audio coder based on the linear prediction filter coefficients.

5. The method of claim 1 further comprising:

producing the speech encoded bitstream and a corresponding speech processed frame only when the input frame is classified as a speech frame;

producing the generic audio encoded bitstream and a corresponding generic audio processed frame only when the input frame is classified as a generic audio frame;

multiplexing the enhancement layer encoded bitstream, the speech encoded bitstream, and the codeword into the combined bitstream only when the input frame is classified as a speech frame; and multiplexing the enhancement layer encoded bitstream, the generic audio encoded bitstream, and the codeword into the combined bitstream only when the input frame is classified as a generic audio frame.

6. The method of claim 5 further comprising:

producing the enhancement layer encoded bitstream based on the difference between the input frame and the processed frame;

wherein the processed frame is a speech processed frame when the input frame is classified as a speech frame; and wherein the processed frame is a generic audio processed frame when the input frame is classified as a generic audio frame.

7. The method of claim 6 further comprising classifying the input frame before producing either the speech encoded bit stream or the generic audio encoded bitstream.

8. The method of claim 6:

wherein the processed frame is a generic audio frame;

the method further comprising:

obtaining linear prediction filter coefficients by performing a linear prediction coding analysis of the processed frame of the generic audio coder; and weighting the difference between the input frame and the processed frame of the generic audio coder based on the linear prediction filter coefficients.

9. The method of claim 1 further comprising:

producing a first difference signal based on the input frame and the speech processed frame and producing a second difference signal based on the input frame and the generic audio processed frame; and classifying the input frame based on a comparison of the first difference and the second difference.

10. The method of claim 1 further comprising classifying the input signal as either a speech signal or a generic audio signal based on a comparison of an energy characteristic of a first set of difference signal audio samples associated with the first difference signal and a second set of difference signal audio samples associated with the second difference signal.

11. The method of claim 1:

wherein the processed frame is a generic audio frame;

the method further comprising:

obtaining linear prediction filter coefficients by performing a linear prediction coding analysis of the processed frame of the generic audio coder;

weighting the difference between the input frame and the processed frame of the generic audio coder based on the linear prediction filter coefficients; and producing the enhancement layer encoded bitstream based on the weighted difference.

* * * * *